US009198508B1

(12) United States Patent
Kufel

(10) Patent No.: US 9,198,508 B1
(45) Date of Patent: Dec. 1, 2015

(54) PORTABLE, COMPACT, AND COLLAPSIBLE SHELVING UNIT

(71) Applicant: Gary W Kufel, Orlando, FL (US)

(72) Inventor: Gary W Kufel, Orlando, FL (US)

( * ) Notice: Subject to any disclaimer, the term of this patent is extended or adjusted under 35 U.S.C. 154(b) by 0 days.

(21) Appl. No.: 14/474,526

(22) Filed: Sep. 2, 2014

Related U.S. Application Data

(60) Provisional application No. 61/872,314, filed on Aug. 30, 2013.

(51) Int. Cl.

| | |
|---|---|
| ***A47F 5/08*** | (2006.01) |
| ***A47B 43/00*** | (2006.01) |
| ***A47B 47/00*** | (2006.01) |
| ***A47B 57/00*** | (2006.01) |
| ***A47B 96/06*** | (2006.01) |
| ***A47F 5/11*** | (2006.01) |
| ***A47B 96/20*** | (2006.01) |
| ***A47B 47/02*** | (2006.01) |
| ***A47F 5/10*** | (2006.01) |
| *A47F 5/00* | (2006.01) |

(52) U.S. Cl.
CPC ..... *A47B 43/00* (2013.01); *A47B 47/0075* (2013.01); *A47B 47/024* (2013.01); *A47B 96/068* (2013.01); *A47B 96/202* (2013.01); *A47F 5/10* (2013.01); *A47F 5/116* (2013.01); *A47F 2005/0075* (2013.01)

(58) Field of Classification Search
CPC .. A47B 43/00; A47B 96/068; A47B 47/0075; A47B 43/02; A47B 43/04; A47B 46/00; A47B 47/00; A47B 47/0066; A47B 47/0091; A47B 47/021; A47B 47/024; A47B 47/027; A47B 47/03; A47B 47/047; A47B 47/06; A47B 55/02; A47B 61/00; A47B 87/02; A47B 87/0207; A47B 87/0276; A47B 96/02; A47B 96/025; A47B 96/04; A47B 96/202; A47F 5/116; A47F 5/10; A47F 5/108; A47F 5/0018; A47F 2005/0075; A47F 5/0081; A47F 5/11; A47F 5/112; A47F 5/114; A47F 5/0025; A47F 3/14
USPC ..... 211/195, 188, 194, 134, 186, 149, 175, 211/72, 135, 150; 312/258, 263; 108/115
See application file for complete search history.

(56) References Cited

U.S. PATENT DOCUMENTS

| | | | | | |
|---|---|---|---|---|---|
| 957,605 | A | * | 5/1910 | Gaynor | 312/6 |
| 1,216,250 | A | * | 2/1917 | Bittle | 312/6 |
| 3,519,318 | A | * | 7/1970 | Hagen | 312/245 |
| 4,270,816 | A | * | 6/1981 | Erickson et al. | 312/3 |
| 4,867,513 | A | * | 9/1989 | Choi | 312/258 |
| 5,163,262 | A | * | 11/1992 | Adams | 52/646 |
| 5,382,087 | A | * | 1/1995 | Pouch | 312/140.2 |
| 5,904,410 | A | * | 5/1999 | Davies | 312/259 |
| 5,957,310 | A | * | 9/1999 | Mitchell | 211/186 |
| 6,119,875 | A | * | 9/2000 | Smith | 211/59.1 |

(Continued)

*Primary Examiner* — Jennifer E Novosad

(57) ABSTRACT

A collapsible shelving unit made out of pleated left and right sidewalls, a top panel, a rear pleated wall, and a multitude of permanent and removable shelves distributed within the sidewalls. The pleated design of the various walls of the shelf allow for the unit to be collapsed to a substantially flat state, ideal for transportation and storage when not in use. In the deployed state, the shelving unit is structurally supported by the rear pleated wall via a multitude of coupling fasteners resulting in a comparable shelving unit to be utilized for storing, selling, and or displaying of items. The portable, compact, and collapsible shelving unit provides the user with a highly efficient and functional shelving unit.

6 Claims, 8 Drawing Sheets

(56) References Cited

U.S. PATENT DOCUMENTS

| | | | | |
|---|---|---|---|---|
| 6,264,030 | B1 * | 7/2001 | Tsou | 206/372 |
| 6,382,435 | B1 * | 5/2002 | Legaz et al. | 211/207 |
| 6,726,046 | B2 * | 4/2004 | Orset | 220/7 |
| 7,669,718 | B1 * | 3/2010 | Patty | 206/774 |
| 8,342,347 | B2 * | 1/2013 | Hay | 220/4.28 |
| 8,453,854 | B2 * | 6/2013 | Baran et al. | 211/201 |
| 8,584,872 | B2 * | 11/2013 | Eiseman | 211/130.1 |
| 8,770,421 | B2 * | 7/2014 | Hay et al. | 220/4.28 |
| 2008/0017638 | A1 * | 1/2008 | Bradford | 220/6 |
| 2012/0187118 | A1 * | 7/2012 | Glenn | 220/6 |
| 2012/0234711 | A1 * | 9/2012 | Vermeulen et al. | 206/386 |
| 2013/0099642 | A1 * | 4/2013 | Wehner et al. | 312/237 |
| 2014/0027396 | A1 * | 1/2014 | Landry et al. | 211/149 |
| 2014/0291262 | A1 * | 10/2014 | Choe | 211/42 |
| 2015/0041420 | A1 * | 2/2015 | Zelek et al. | 211/149 |
| 2015/0083682 | A1 * | 3/2015 | Barre et al. | 211/118 |
| 2015/0164040 | A1 * | 6/2015 | Anderson | |

* cited by examiner

PORTABLE, COMPACT, AND COLLAPSIBLE SHELVING UNIT

The current application claims a priority to the U.S. Provisional Patent application Ser. No. 61/872,314 filed on Aug. 30, 2013. The current application is filed on Sep. 2, 2014 while Aug. 30, 2014 was on a weekend. The next business day is Sep. 2, 2014 while Aug. 31, 2014 was a weekend and Sep. 1, 2014 was a national holiday (Labor Day).

FIELD OF THE INVENTION

The present invention relates generally to a shelving unit. More specifically, the present invention is a collapsible shelving unit that temporarily provides shelving space for the user and may be easily transported to a new location with minimal effort.

BACKGROUND OF THE INVENTION

A shelf is a flat and often horizontal surface that is used to store and or display items at home, business establishments, or stores. A shelving unit is a plurality of shelves combined together for maximum storage capacity; shelving units may come in a range of designs each with its specific functions. The majority of shelving units are composed of a rigid body containing thick pieces of wooden or metallic slabs arranged together to create a plurality of shelves that cover a substantial amount of space; these designs most often require multiple people for transportation and installation. Some of the more luxurious shelving units utilize the ceiling and or the wall to create the support structure for the shelves and as a result are extremely complicated when it comes to transportation and installation. For the majority of population these designs provide adequate shelving space and are worth the initial transportation and installation requirements. Furthermore, for many individuals there is never enough shelf space to accommodate the items that they may have. However, adding more shelves can lead to clutter and space restrictions.

It is therefore an object of the present invention to provide a shelving unit that is portable, collapsible, and can be used as temporary shelf space whenever a user desires. This type of shelf is ideal for street merchants, college students, traveling salesman, daily use, and other similar careers and or situations. The present invention may be assembled substantially faster than the average shelving unit and in the collapsed state takes up a small amount of space and thus allowing the user to easily store the shelving unit under the bed, in the closet, and other small spaces. Additionally, the small nature of the collapsed unit creates an ideal size and weight for transportation purposes.

DETAILED DESCRIPTIONS OF THE INVENTION

All illustrations of the drawings are for the purpose of describing selected versions of the present invention and are not intended to limit the scope of the present invention.

Figure 1:
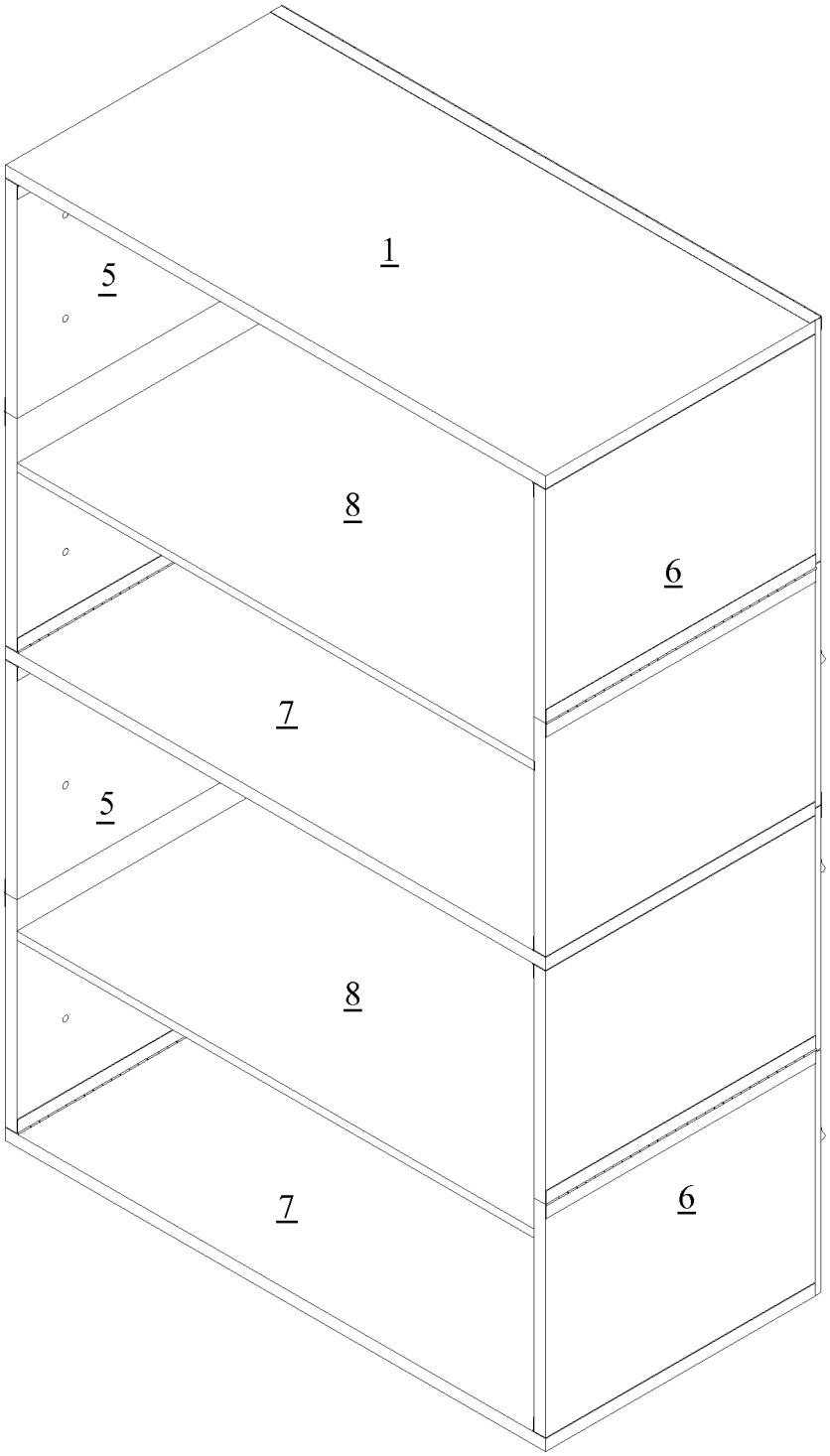
FIG. 1 is a perspective view of the present invention.
Figure 5:
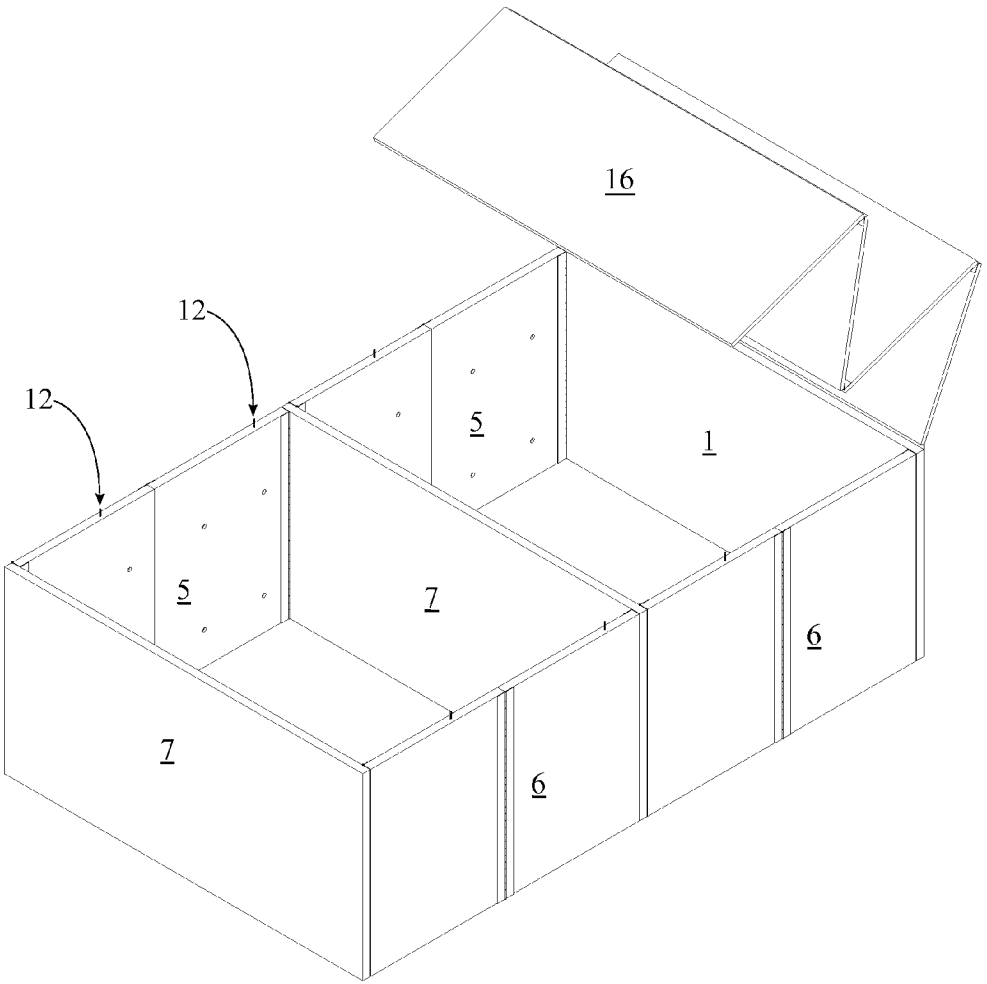
FIG. 5 is a rear perspective view of the present invention with the rear pleated wall being collapsed into the compacted configuration without the plurality of shelf assemblies.
Figure 6:
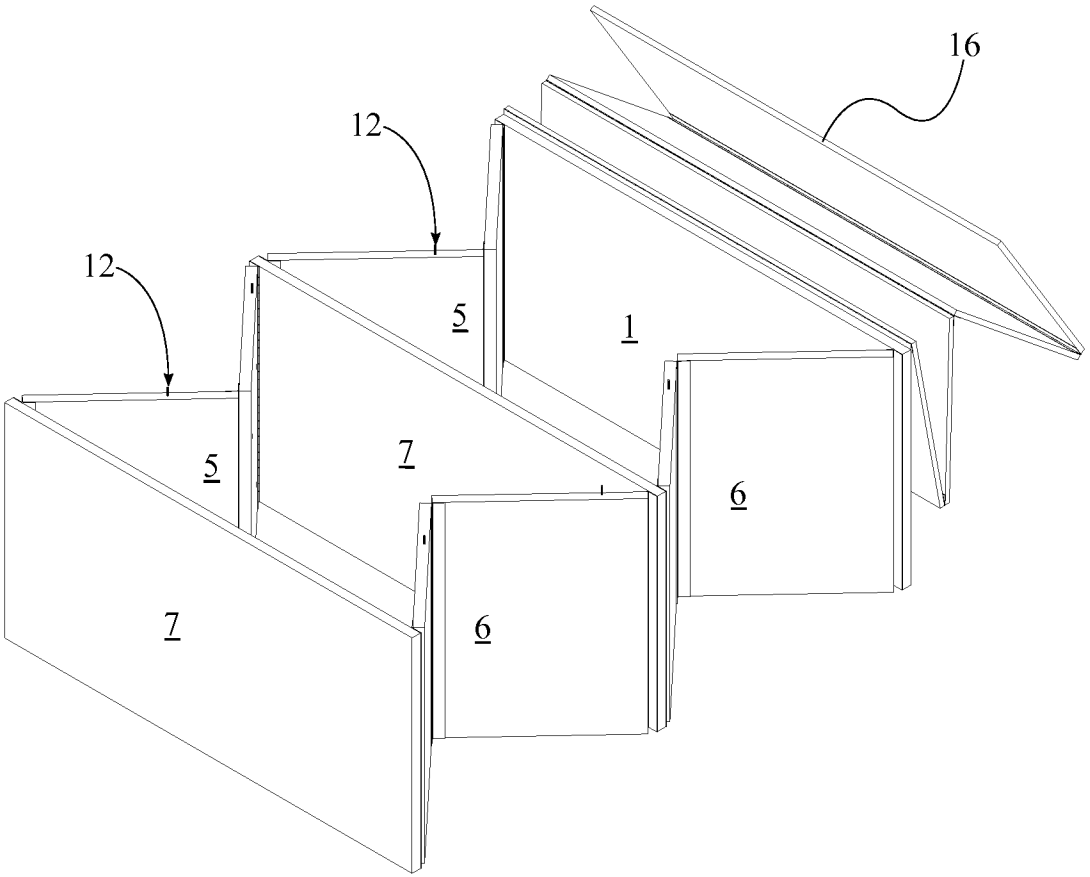
FIG. 6 is a rear perspective view of the present invention being collapsed into the compacted configuration without plurality of shelf assemblies.
Figure 7:
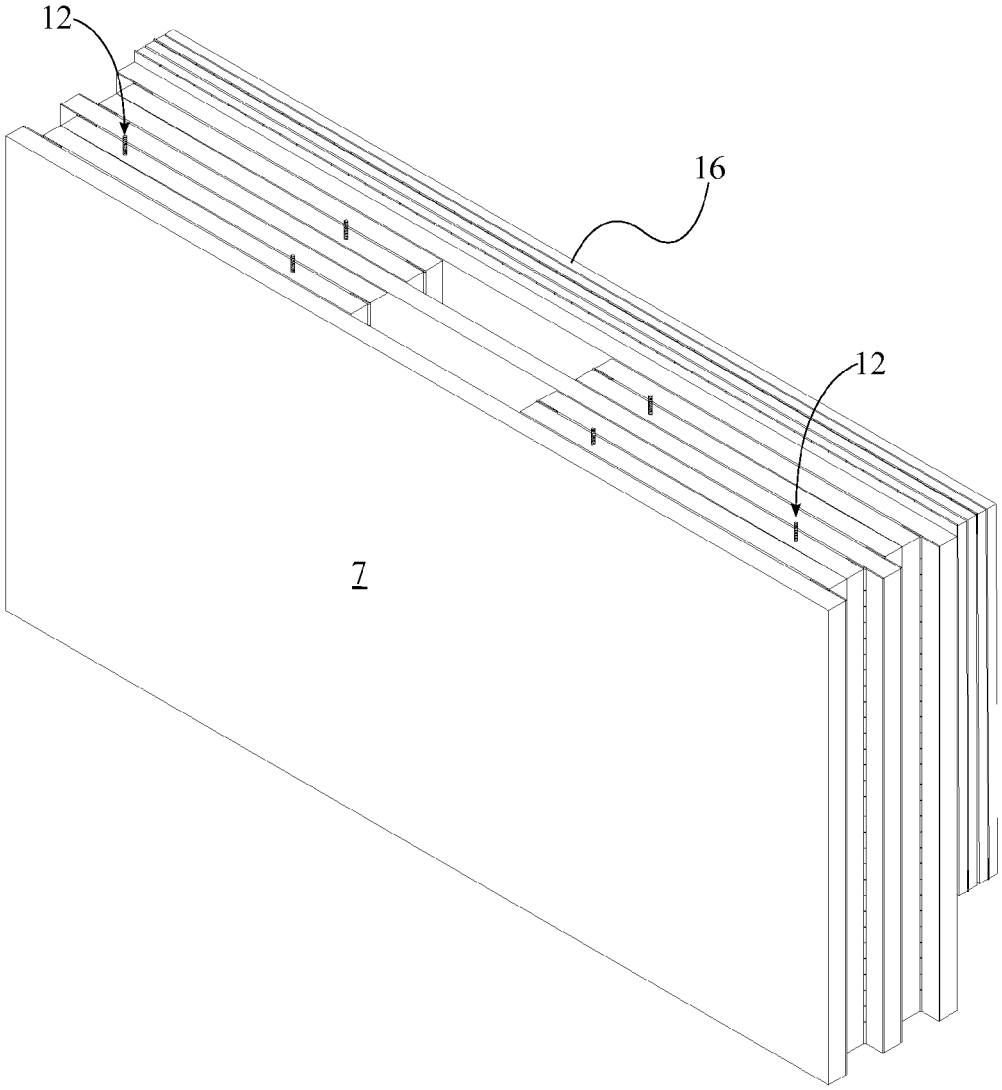
FIG. 7 is a rear perspective view of the present invention in the compacted configuration without plurality of shelf assemblies.
Figure 8:
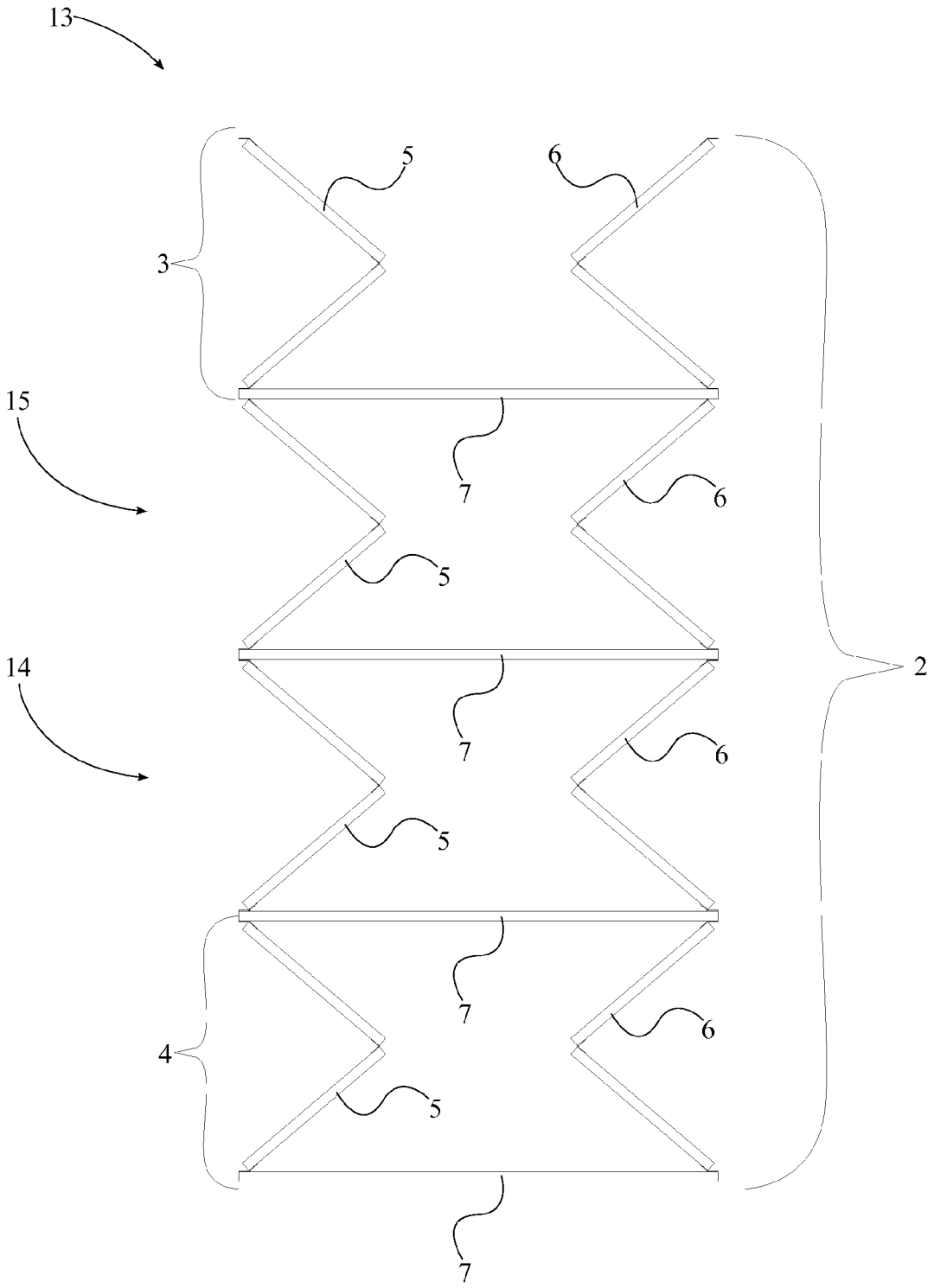
FIG. 8 is a front view of the plurality of frame sections in a series of box pleats without the rear pleated wall, plurality of shelf assemblies, and the top panel.

As can be seen in FIG. 1 through FIG. 8, the present invention is a portable and collapsible shelving unit. The present invention comprises a top panel 1, a plurality of frame sections 2, and a rear pleated wall 16. The plurality of frame sections 2 comprises a top section 3 and a bottom section 4. Each of the plurality of frame sections 2 comprises a first pleated sidewall 5, a second pleated sidewall 6, and a permanent shelf 7. The plurality of frame sections 2 is connected together as a series of stacked box pleats as seen in FIG. 8 with the bottom section 4 and top section 3 being located at the lowest and highest positions, respectfully. The top panel 1 maintains the first pleated sidewall 5 and second pleated sidewall 6 of the top section 3 in their offset orientation at all times. The present invention contains two configurations, a deployed configuration and compacted configuration. The deployed configuration includes the first pleated sidewall 5 and second pleaded sidewall 6 being expanded to the maximum length and being supported by the similarly expanded rear pleated wall 16 to resemble a typical shelving unit as seen in FIG. 1. The compacted configuration folds down the first pleated sidewall 5, second pleated sidewall 6, and the rear pleated wall 16 into a substantially smaller state than the deployed configuration as seen in FIG. 7. The compacted configuration is ideal for storage and transportation of the present invention.

In the deployed configuration, the present invention embodies a normal shelf design with two side walls, a back wall, a bottom wall, a top wall, and a plurality of shelves distributed inside the cavity thereof. In the deployed configuration, the height, width, and depth are preferably 36, 24, and 12 inches respectfully. In alternative embodiments of the present invention, the various dimensions and number of frame sections vary to yield larger or smaller version of the present invention with the same deployed and compact configurations. In the compacted configuration, the total height of the present invention is preferably about six inches, a substantial decrease in height which lends itself to be easily carried and stored. The present invention preferably utilizes wood or plastic based slabs for the plurality of frame sections 2, top panel 1, and rear pleated wall 16 to ensure the rigidity and lightweight property of the present invention; in alternative embodiments, different materials may be utilized instead.

Figure 2:
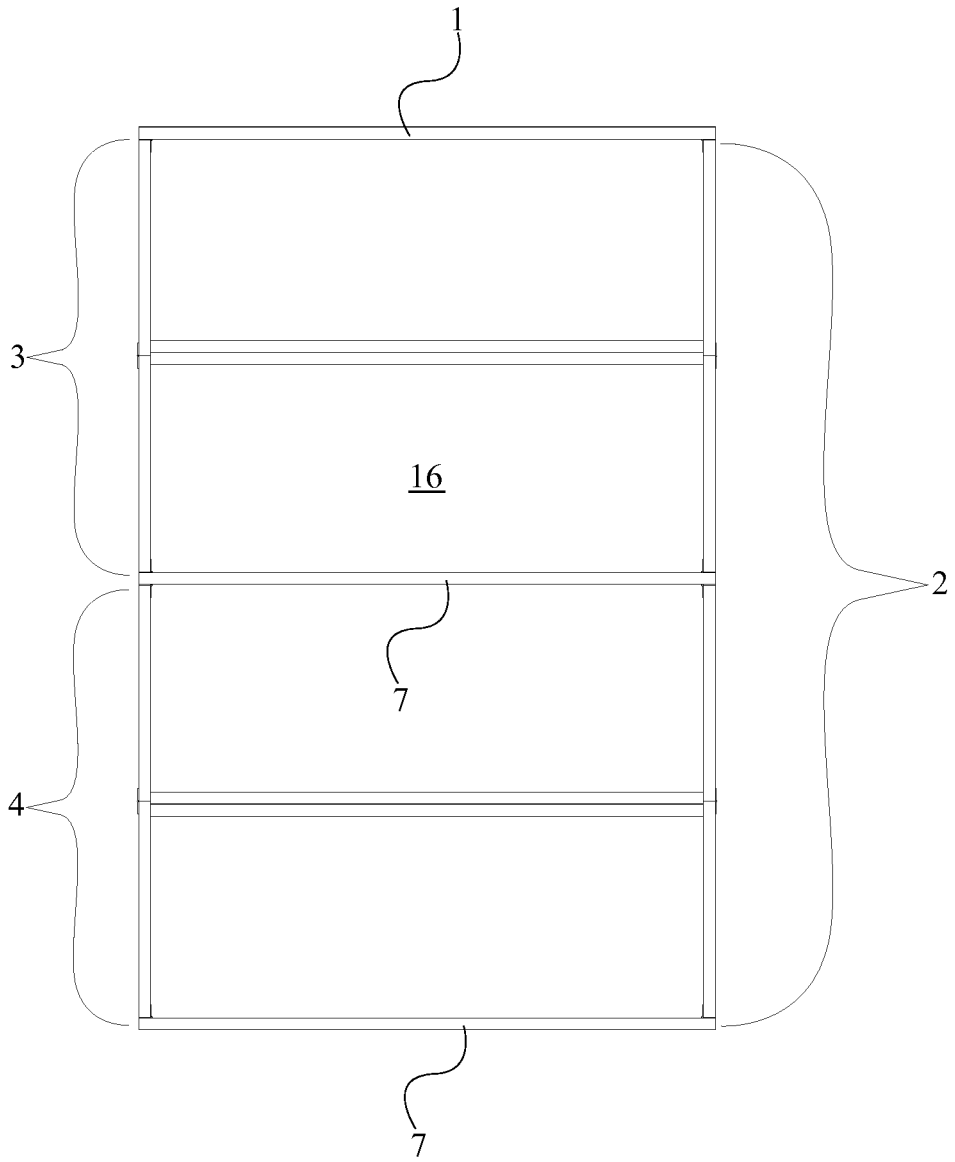
FIG. 2 is a front view of the present invention without the plurality of shelf assemblies.

In reference to FIG. 2, the first pleated sidewall 5 makes up the left wall of the shelf and the second pleated sidewall 6 the right wall of the present invention; located in between is the permanent shelf 7 component. Both, the first pleated sidewall 5 and the second pleated sidewall 6, are hingedly and adjacently connected to the permanent shelf 7; the second pleated sidewall 6 is positioned opposite the first pleated sidewall 5 to create a semi-enclosed space as seen in FIG. 1 to be utilized for the placement and storage of items. The present invention preferably uses a piano hinge to hingedly connect the first pleated sidewall 5 and the second pleated sidewall 6 to the permanent shelf 7. Additionally, piano hinges are also preferably utilized for the hinged design of the first pleated sidewall 5, second pleated sidewall 6, and the rear pleated wall 16. However, various different hinge mechanisms may be utilized to hingedly connect the first pleated sidewall 5 and the second pleated sidewall 6 to the permanent shelf 7 including as well as other hinge based designs, but not limited to, case hinges, pivot hinges, butt hinges, flag hinges, and other comparable mechanisms. The hinged connection in conjunction with the pleated sidewall designs allows for the first pleated sidewall 5 and second pleated sidewall 6 to be able to collapse down on top of the permanent shelf 7 as seen in FIG. 6 and FIG. 7, thus allowing the user to easily store and transport the present invention.

The plurality of frame sections 2 is connected together as a series of stacked box pleats as seen in FIG. 8. The design of the present invention lends itself to various alternative embodiments, each dependent on the size and number of frame sections 2 utilized within the series of stacked box pleats. More specifically, the higher the number of frame sections 2 utilized in the present invention, the larger storage capacity. In a similar fashion, the less number of frame sections 2, the smaller storage capacity. The top section 3 is a single instance of the plurality of frame sections 2 that is located at the highest point of the configuration. In a similar fashion, the bottom section 4 is a single instance of the plurality of frame sections 2 that is located at the lowest point of the configuration, opposite the top section 3. The top panel 1 is shaped and designed similar to the permanent shelf 7 and acts as the roof for the top section 3 and in turn the whole shelving unit. The top panel 1 is hingedly and adjacently connected to the first pleated sidewall 5 of the top section 3; the second pleated sidewall 6 of the top section 3 is also hingedly and adjacently connected to the top panel 1, opposite the first pleated sidewall 5 of the top section 3. Furthermore, the top panel 1 is positioned opposite to the permanent shelf 7 of the top section 3. Essentially, the top panel 1 roofs the open region of the top section 3 to add rigidity and structural support for the rest of the plurality of frame sections 2.

Figure 4:
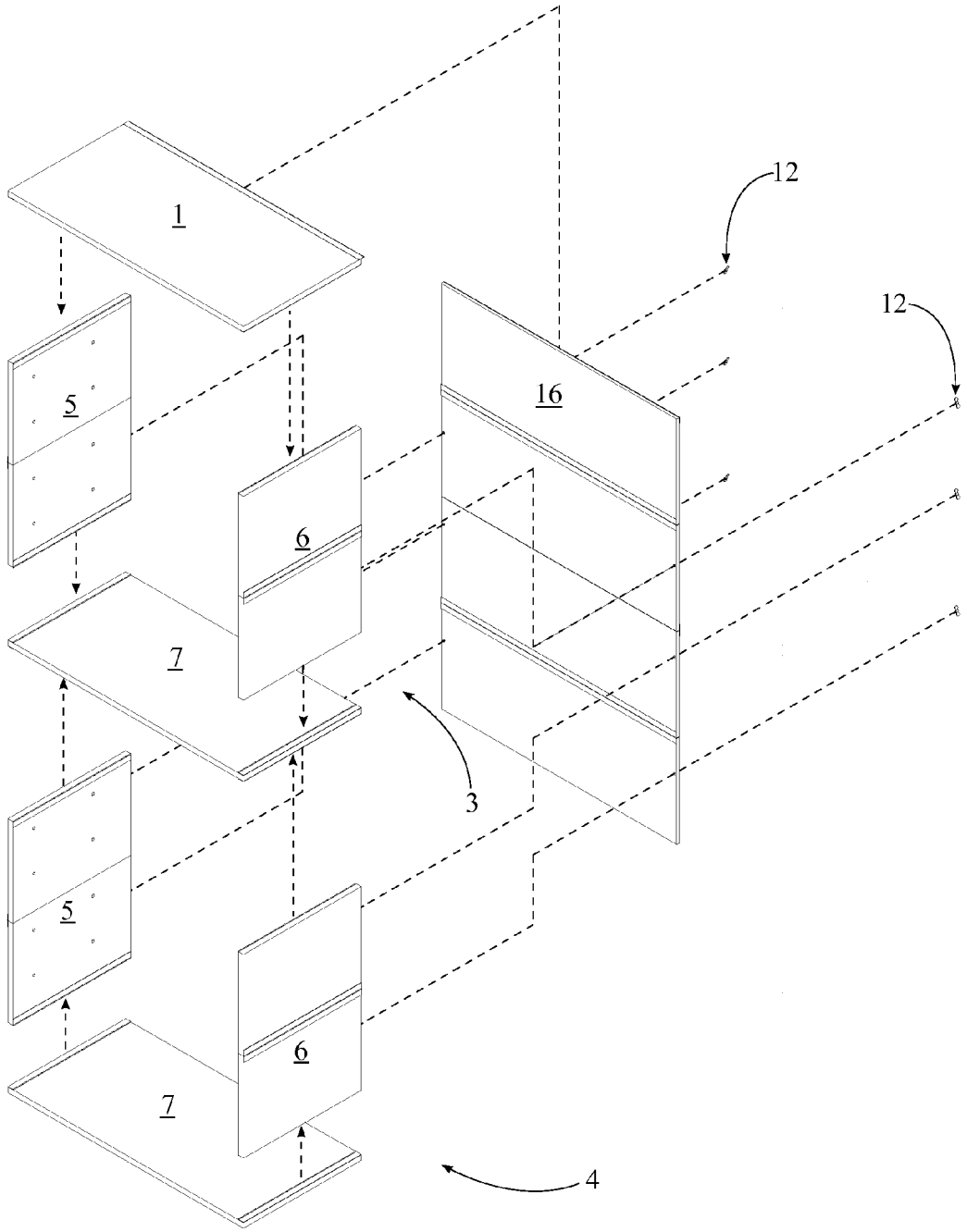
FIG. 4 is an exploded view of the present invention without the plurality of shelf assemblies.

The rear pleated wall 16 adds the rear backing to the present invention and provides the structural support for the whole apparatus during the deployed configuration via a plurality of fasteners 12. In the compacted configuration, the rear pleated wall 16 folds down onto itself to a substantially smaller state in a similar fashion as the first pleated sidewall 5 and second pleated sidewall 6 of each of the plurality of frame sections 2. The rear pleated wall 16 is positioned in between the first pleated sidewall 5 and the second pleated sidewall 6; and spans a width that is at least the distance between the first pleated sidewall 5 and second pleated sidewall 6 as seen in FIG. 4 to fully enclose the space in between. The length of the rear pleated wall 16 in the deployed configuration is at least the distance between the permanent shelf 7 of the bottom section 4 to the top panel 1; this covers the rear face of the plurality of frame sections 2. The rear pleated wall 16 comprises a plurality of rectangular slabs that is configured in a pleated design through a plurality of hinged couplings as seen in FIG. 5. The length, width, thickness, and number of the rectangular slabs are subject to change to accommodate a variety of different designs.

Each of the plurality of frame sections 2 has a corresponding box pleat 14 within the series of box pleats 13. Additionally, the corresponding box pleat 14 contains an adjacent box pleat 15 within the series of box pleats 13. This is mostly in reference to an instance when more than two frame sections 2 are utilized as seen in FIG. 8, the following component connections describe how multiple frame sections 2 are joined together. The permanent shelf 7 of the adjacent box pleat 15 is hingedly and adjacently connected to the first pleated sidewall 5 of the corresponding box pleat 14, opposite to the permanent shelf 7 of the corresponding box pleat 14. The second pleated sidewall 6 of the corresponding box pleat 14 is hingedly and adjacently connected to the permanent shelf 7 of the adjacent box pleat 15, opposite to the first pleated sidewall 5 of the corresponding box pleat 14 as seen in FIG. 8.

In the deployed configuration, the present invention is a stand-alone rigid shelving unit. In the deployed configuration, the first pleated sidewall 5 and the second pleated sidewall 6 of each of the plurality of frame sections 2 are positioned parallel to each other. Additionally, the first pleated sidewall 5 and the second pleated sidewall 6 are orientated perpendicular to the associated permanent shelf 7; and the top panel 1 is positioned parallel the permanent shelf 7. The plurality of frame sections 2 is held in the deployed configuration via the rear pleated wall 16. The rear pleated wall 16 is positioned along the plurality of frame sections 2. More specifically, the rear pleated wall 16 is adjacently and perpendicularly attached to the first pleated sidewall 5, the second pleated sidewall 6, and the permanent shelf 7 as seen in FIG. 2; the rear pleated wall 16 is attached via the plurality of fasteners 12.

In the compacted configuration, the present invention is collapsed into a relatively thin and flat shape. In this configuration the first pleated sidewall 5 and the second pleated sidewall 6 are folded down and positioned parallel to the permanent shelf 7. In addition, the rear pleated wall 16 is folded down and adjacently positioned parallel to the top panel 1, opposite the top section 3 as seen in FIG. 7.

The plurality of fasteners 12 is perimetrically positioned around the rear pleated wall 16. The plurality of fasteners 12 is used to adjacently attach the rear pleated wall 16 to the plurality of frame sections 2 as seen in FIG. 4. The present invention preferably utilizes threaded studs in conjunction with wing nuts as the plurality of fasteners 12. The threaded studs are distributed about the back surface of the plurality of frame sections 2. A plurality of complimentary through holes that is distributed about the outer perimeter of the rear pleated wall 16, coincident with the threaded studs on the plurality of frame sections 2. To attach, the rear pleated wall 16 is aligned perpendicular to the plurality of frame sections 2 with the threaded studs traversing through the complimentary through holes and the wing nuts are screwed on the threaded studs. Even though the present invention preferably utilizes the threaded studs and the wing nuts as the plurality of fasteners 12, alternative type of fastener may be utilized within the present invention. The alternative type of fastener can include, but are not limited to, bolts, screws, pin—slot mechanisms, and other comparable means.

Figure 3:
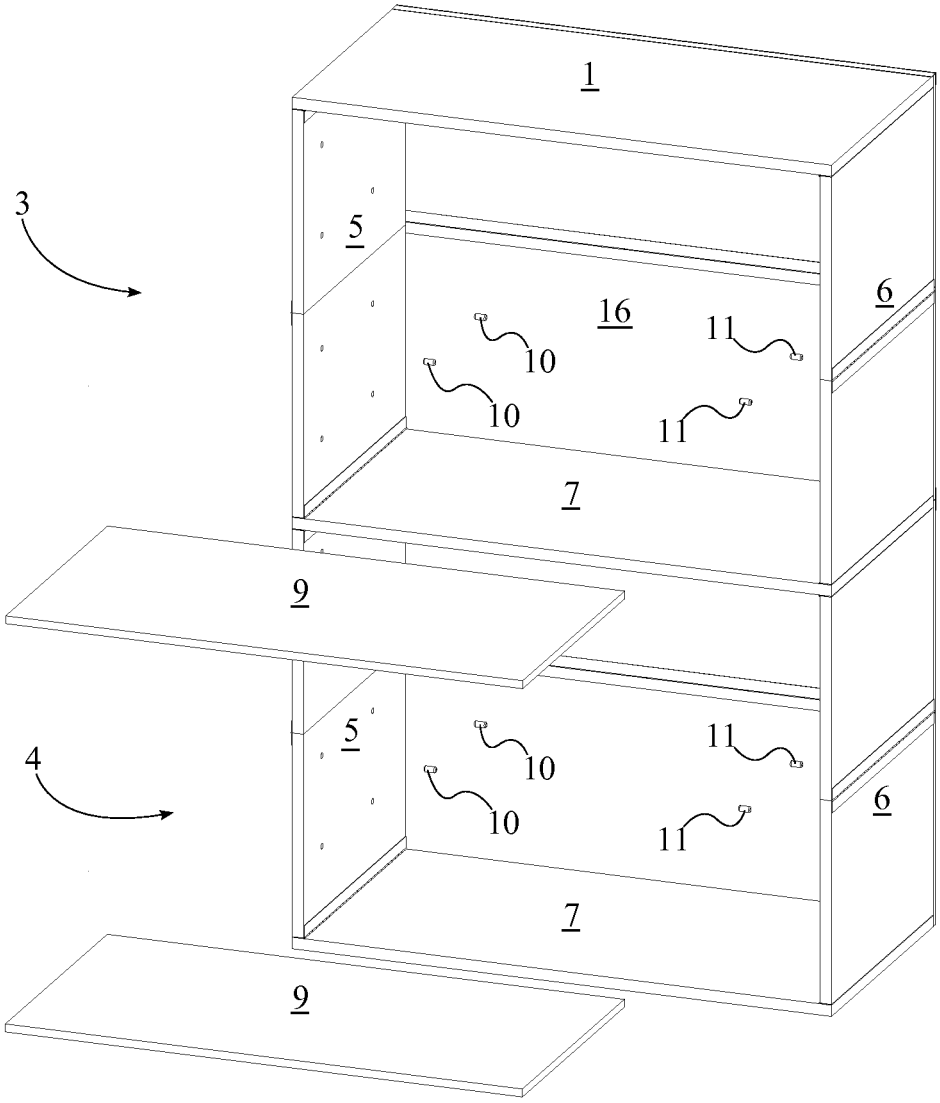
FIG. 3 is a partially exploded perspective view of the present invention depicting the plurality of shelf assemblies.

The number of horizontal planes within the plurality of frame sections 2 may be increased through the incorporation of a plurality of removable shelf assemblies 8. Each of the plurality of shelf assemblies 8 comprises a shelf 9, at least two first pegs 10, and at least two second pegs 11. Through the use of at least two first pegs 10 and at least two second pegs 11, the shelf 9 is mounted within and amongst the plurality of frame sections 2 as seen in FIG. 1. Each of the at least two first pegs 10 are mounted normal to the first pleated sidewall 5, preferably a certain distance apart. In a similar fashion, each of the at least two second pegs 11 are mounted normal to the second pleated sidewall 6. The at least two first pegs 10 and the at least two second pegs 11 are positioned equidistant to the top panel 1; this ensures that the at least two first pegs 10 and the at least two second pegs 11 are aligned along a single flat horizontal plane. The shelf 9 resembles a design similar to the permanent shelf 7 with slightly smaller dimensions. The shelf 9 mounts onto the at least two first pegs 10 and the at least two second pegs 11 as seen in FIG. 3 to provide the user with additional levels upon which additional items may be stored. The inside surface of the first pleated sidewall 5 and the second pleated sidewall 6 contain a plurality of blind holes distributed about the length of the components to which the at least two first pegs 10 and the at least two second pegs 11 may be mounted on. The use of the at least two first pegs 10, the at least two second pegs 11, and blind holes increases the ease of use of the present invention; and allows the user to quickly and easily add or remove additional shelf assemblies 8 as needed.

Although the invention has been explained in relation to its preferred embodiment, it is to be understood that many other possible modifications and variations can be made without departing from the spirit and scope of the invention as hereinafter claimed.

What is claimed is:

1. A portable, compact, and collapsible shelving unit comprises:

a top panel;

a plurality of frame sections;

a rear pleated wall;

the plurality of frame sections comprises a top section and a bottom section;

each of the plurality of frame sections comprises a first pleated sidewall, a second pleated sidewall, and a permanent shelf;

the first pleated sidewall being hingedly and adjacently connected to the permanent shelf;

the second pleated sidewall being hingedly and adjacently connected to the permanent shelf, opposite to the first pleated sidewall;

the plurality of frames sections being connected together as a series of stacked box pleats;

the top section and the bottom section being positioned opposite of each other;

the top panel being hingedly and adjacently connected to the first pleated sidewall of the top section, opposite to the permanent shelf of the top section;

the second pleated sidewall of the top section being hingedly and adjacently connected to the top panel, opposite to the first pleated sidewall of the top section;

the rear pleated wall being positioned in between the first pleated sidewall and the second pleated sidewall; and the rear pleated wall being hingedly and adjacently connected along the top panel.

2. The portable, compact, and collapsible shelving unit as claimed in claim 1 comprises:

each of the plurality of frame sections having a corresponding box pleat within the series of box pleats;

the corresponding box pleat having an adjacent box pleat within the series of box pleats;

the permanent shelf of the adjacent box pleat being hingedly and adjacently connected to the first pleated sidewall of the corresponding box pleat, opposite to the permanent shelf of the corresponding box pleat; and the second pleated sidewall of the corresponding box pleat being hingedly and adjacently connected to the permanent shelf of the adjacent box pleat, opposite to the first pleated sidewall of the corresponding box pleat.

3. The portable, compact, and collapsible shelving unit as claimed in claim 1 comprises:

wherein when the top panel, the plurality of frame sections, and the rear pleated wall is placed into a deployed configuration;

the first pleated sidewall and the second pleated sidewall being positioned parallel to each other;

the first pleated sidewall and the second pleated sidewall being positioned perpendicular to the permanent shelf;

the top panel being positioned parallel to the permanent shelf;

the rear pleated wall being positioned along the plurality of frame sections; and the rear pleated wall being adjacently and perpendicularly attached to the first pleated sidewall, the second pleated sidewall, and the permanent shelf.

4. The portable, compact, and collapsible shelving unit as claimed in claim 3 comprises:

a plurality of removable shelf assemblies;

each of the plurality of removable shelf assemblies comprises a shelf, at least two first pegs, and at least two second pegs;

the plurality of removable shelf assemblies being mounted within and amongst the plurality of frame sections;

each of the at least two first pegs being mounted normal to the first pleated sidewall;

each of the at least two second pegs being mounted normal to the second pleated sidewall;

the at least two first pegs and the at least two second pegs being positioned equidistant to the top panel; and the shelf being mounted onto the at least two first pegs and the at least two second pegs.

5. The portable, compact, and collapsible shelving unit as claimed in claim 3 comprises:

a plurality of fasteners;

the plurality of fastener being perimetrically positioned around the rear pleated wall; and the rear pleated wall being adjacently attached to the plurality of frames sections and the top panel by the plurality of fasteners.

6. The portable, compact, and collapsible shelving unit as claimed in claim 1 comprises:

wherein when the top panel, the plurality of frame sections, and the rear pleated wall is placed into a compacted configuration;

the first pleated sidewall and the second pleated sidewall being positioned parallel to the permanent shelf;

the rear pleated wall being positioned parallel to the top panel; and the rear pleated wall being positioned adjacent to the top panel, opposite the top section.

* * * * *